United States Patent [19]

DuRocher

[11] Patent Number: 4,860,580

[45] Date of Patent: Aug. 29, 1989

[54] FORMATION TESTING APPARATUS AND METHOD

[76] Inventor: David DuRocher, P.O. Box 821, College Station, Tex. 77841

[21] Appl. No.: 268,333

[22] Filed: Nov. 7, 1988

[51] Int. Cl.[4] ..... E21B 49/10

[52] U.S. Cl. ..... 73/155; 166/264

[58] Field of Search ..... 73/151, 155; 166/100, 166/250, 264

[56] References Cited

U.S. PATENT DOCUMENTS

| | | | |
|---|---|---|---|
| 2,313,176 | 3/1943 | Shelby | 166/100 |
| 2,781,663 | 2/1957 | Maly et al. | 166/264 |
| 3,104,712 | 9/1963 | Whitten | 166/100 |
| 3,261,402 | 7/1966 | Whitten | 166/63 |
| 3,295,615 | 1/1967 | Brieger et al. | 175/4.52 |
| 3,344,860 | 10/1967 | Voetter | 166/100 |
| 3,430,181 | 2/1969 | Urbanosky | 439/194 |
| 3,577,781 | 5/1971 | Lebourg et al. | 166/264 |
| 3,611,799 | 10/1971 | Davis | 73/155 |
| 3,780,575 | 12/1973 | Urbanosky | 166/100 |
| 4,210,018 | 7/1980 | Brieger | 73/155 |
| 4,553,428 | 11/1985 | Upchurch | 73/155 |
| 4,745,802 | 5/1988 | Purfurst | 166/264 |

OTHER PUBLICATIONS

James M. Gunter and C. V. Moore, "Improved Use of Wireline Testers for Reservoir Evaluation," Journal of Petroleum Technology, Jun. 1987, p. 635.

*Primary Examiner*—Stewart J. Levy
*Assistant Examiner*—Kevin D. O'Shea
*Attorney, Agent, or Firm*—Charles D. Gunter, Jr.

[57] ABSTRACT

A formation testing apparatus is shown for testing subsurface earth formations penetrated by a borehole. A tester body has two longitudinally spaced sealing pads which are used to isolate a portion of the well bore from well bore fluids. A pair of sample collectors are carried by the body and communicate thru openings provided in the sealing pads for receiving samples of connate fluids produced from the surrounding formations. A pair of control fluid passages containing a control fluid of known density are pressure communicative with the connate fluid contained in each sample passageway. A pressure sensor is provided for sensing the pressure of the known density fluid in the control fluid passages and for comparing the pressures to determine a fluid pressure-depth gradient from which the nature of the connate fluid in the earth formations adjacent the formation testing device can be predicted.

16 Claims, 5 Drawing Sheets

FORMATION TESTING APPARATUS AND METHOD

BACKGROUND OF THE INVENTION

1. Field of the Invention

This information relates to devices for gathering information with respect to fluids in subsurface earth formations penetrated by a well bore and, specifically, to a device and method for providing a more reliable indication of the nature of the fluid or fluids in the subsurface formation surrounding the borehole.

2. Description of the Prior Art

A number of wireline formation testing devices are known in the oil and gas industry. In use, such devices are suspended from a wireline from the earth's surface and are lowered downwardly within the well bore. Such devices are used to gather information about the fluids in the subsurface formations surrounding the borehole. The pressure of fluid in an earth formation and the rate at which that fluid enters a low pressure sample chamber from a borehole surface of known area are two of the most frequently recorded values. Another common use of such devices is to obtain fluid samples which are brought to the earth's surface and preserved for laboratory examination.

The wireline formation testing device has evolved steadily since its inception. Contemporary wireline formation testing devices are typically designed with the capacity to make an unlimited number of fluid pressure tests and to obtain one or two fluid samples per trip into the well bore. The earliest versions, such as that described in U.S. Pat. No. 2,747,402, were not commercially successful due to numerous shortcomings. The early devices often failed to achieve successful isolation of a portion of the borehole surface. The internal flow lines frequently became plugged with formation materials during efforts to obtain pressure readings for fluid samples. The early devices also utilized less accurate pressure measuring means than do contemporary formation testing devices.

Over the years, improvements have been steadily introduced to correct many of the deficiencies associated with the early wireline formation testing devices. Although the present day wireline formation tester is commercially successful and is often relied upon to provide valuable information which aids in the evaluation of potentially production oil and gas wells, certain deficiencies continue to exist.

The operation of present day formation testing devices is discussed in such articles as "Improved Use of Wireline Testers for Reservoir Evaluation", by Gunter and Moore, *Journal of Petroleum Technology,* June 1987. This article describes a technique by which a formation tester can be used to determine the density of fluids in an earth formation where the earth formation is fluid continuous over a given depth interval. A formation tester is used to measure fluid pressures at a number of depths within the interval. Pressure versus depth data is plotted and the slope of the resulting curve defines a fluid pressure-depth gradient. Fluid density determines the value of such a gradient.

Fluids such as water, oil and gas are known to have different pressure-depth gradients. Also, the pressure-depth gradient of each of these fluids remains substantially the same over relatively small depth intervals of, e.g., 300 to 400 feet. Thus, any distinct change in the slope of a pressure-depth curve serves to indicate a transition point from one type of fluid to another.

In many cases, however, an earth formation penetrated by a well bore contains only one type of moveable fluid over the interval studied. In such cases, the pressure gradient indicated by a pressure-depth plot will closely conform to a straight line. And, as already mentioned above, the slope of the line will conveniently indicate the type of fluid present in the formation. For example, pressure-depth gradients of 0.05 psi per foot, 0.35 psi per foot, and 0.46 psi per foot would suggest the presence of gas, oil and water, respectively, as the moveable formation fluids.

It should be noted that the density of gas is in part dependent upon absolute pressure and temperature, the density of oil is in part dependent upon the amount of absorbed gas it contains, and the density of water is in part dependent upon the amount of dissolved solids. Nevertheless, for practical purposes, no overlapping of densities of these fluids is encountered in the course of formation analysis.

It will also be understood that in a single moveable fluid environment, only two fluid pressure measurements taken at known depths are needed to determine the pressure-depth gradient. Such a determination, in turn, provides a highly reliable means of establishing moveable fluid type.

With this general discussion of the operation of the modern day formation testing device in mind, one limitation should be readily apparent. The accurate determination of a pressure-depth gradient is dependent upon the accuracy of the pressure measurements provided by the formation tester's pressure measurement instruments and the accuracy of the depth readings which are used to define the plot. The latter readings are normally provided by instruments and devices contained in a logging truck which is attached to the wireline which serves to transport the formation tester as it penetrates the borehole from the well surface.

Currently, formation testing devices typically incorporate both a quartz gauge and a strain gauge in their design. The quartz gauge provides both higher resolution and higher absolute pressure measurement accuracy than the strain gauge. One commercially available quartz gauge which is currently used for well bore measurements is the Hewlett Packard HP2813E/D. Published specifications for this gauge are:

OPERATING ENVIRONMENT

- CALIBRATED PRESSURE RANGE: 200–11,000 psi.
- CALIBRATED TEMPERATURE RANGE: 95°–350° F.

STATIC MEASUREMENT (pressure and temperature are constant).

- ACCURACY: plus or minus [1.0 psi (due to curve fit error)+0.01% of actual pressure (due to calibration system error)].
- REPEATABILITY: plus or minus 1.0 psi over the entire calibrated pressure and temperature range; or, plus or minus 0.4 psi over the entire calibrated pressure range with temperature held to a single value.
- RESOLUTION: 0.001 psi when sampling for 1 second.

It is also common for well service contractors to modify the quartz gauges that are installed in their formations testers. Thus, the above specification serve only as an approximate guide to gauge performance. In addition to the performance changes resulting from modifications, it should also be noted that the above specifications assume that temperature is constant during the measurement time interval. If temperature is not constant, pressure measurement errors can normally be expected to be considerably higher than those incurred during intervals of constant temperature.

The condition of constant temperature during a pressure test is, in actual practice, difficult to achieve. There are many reasons, including the fact that the temperature of the well bore changes continuously with depth. Typical earth temperature gradients range from one to two degrees F. per 100 feet. Thus, a formation testing device is subjected to continuously changing temperature as it traverses the well bore. Also, when the formation testing device is positioned in the well bore for the purpose of testing a particular subsurface formation, the temperature adjustments of internal components do not occur instantly.

Another factor which affects the temperature of tool components is the cooling effect which results when certain formation fluids which are liquid in the connate state vaporize entirely or partly as a result of entering the low pressure environment of the tester's pretest chamber. Then, as the pressure test proceeds, the reverse effect normally occurs and heat is released as the gaseous material recondenses. The recondensation occurs because the fluid in the pretest chamber again approaches the original formation fluid pressure.

There are at least two other factors which may affect the tool's rate of temperature change. One is the heat which is generated as a result of operating the hydraulic system or other means used to position the sealing means against the borehole wall. The second is the heat which is generated by various electronic components which operate within the tool housing. In this dynamic heat environment, constant temperature conditions are virtually impossible to achieve with certainty.

One well service contractor in a printed release describing the performance capabilities of its formation testing device has stated that selected, modified Hewlett Packard gauges will have a maximum error of 20 psia when the rate of temperature changes 1–2 degrees F. per minute and that pressure measurement error will be within plus or minus 2 psia when the rate of temperature change is less than 0.5° F. per minute.

Assuming arbitrarily that an absolute pressure measurement accuracy of plus or minus 0.5 psia is achievable, it can be determined that a pressure-depth gradient error calculated using two readings taken 100 feet apart would result in a maximum gradient error of plus or minus 0.01 psi per foot. If the two readings indicated a 0.44 psi per foot pressure-depth gradient, for example, it could be assumed with confidence that the true gradient value was somewhere in the range of 0.43–0.45 psi per foot. Since the pressure-depth gradient for oil will in all circumstances be considerably lower than 0.43 psi per foot, the accuracy of the gradient calculation would be quite sufficient to determine that the fluid type was water. Likewise, if the moveable formation fluid had been gas or oil, an error of plus or minus 0.01 psi per foot would have in fact been sufficiently small to allow accurate determination of the fluid type.

Now assume that the two pressure readings are taken some ten feet apart in a fluid continuous formation. The error assumption of plus or minus 0.5 psia would now translate into a pressure-depth gradient error of plus or minus 0.1 psia per foot. If the two recorded readings taken by the formation tester indicated a pressure-depth gradient of 0.40 psi per foot, for example, then the true gradient value could be anywhere in the range of 0.30–0.50 psi per foot. The high part of that range would indicate water as the fluid type and the lower portion would indicate oil as the fluid type. Certainly there could be times when the readings generated by the formation tester would indicate only one possible fluid. For example, an indicated gradient of 0.53 psi per foot would suggest only water as the fluid type. However, in general, it can be seen that two readings taken at a depth differential of ten feet would not generate pressure readings of sufficient accuracy to predict the type of moveable fluid with confidence.

A second error causing factor which was not considered in the above two examples is that one or both depth readings may be incorrect. If, for example, two readings are taken over what is believed to be a ten foot interval, and the true pressure gradient is 0.433 psi per foot, a plus or minus 0.5 psi measurement accuracy could be assumed to produce a measurement in the range of 0.483–0.383 psi per foot. However, if the vertical distance between readings is nine feet to eleven feet, the pressure gradient reading could lie anywhere in the 0.34 and 0.53 psi per foot range.

Depth errors are conceivable because many earth formations selected for testing are permeable. Consequently, it is not uncommon for the well bore surface to be covered with a layer of mud cake. Such mud cake can vary in thickness and can also be scraped off as the formation tester is moved to penetrate the well bore. Thus, the formation tester, which is normally of larger diameter than other logging tools which may have preceded it, may unpredictably be subjected to a downward pull resulting from mud cake friction as it is moved upward vertically into position for a formation test. Such a force would be added to the normal weight of the logging cable and formation tester and could cause the cable to stretch to a length greater than would otherwise be the case.

Clearly, given the above assumptions, the absolute pressure measuring capacity of prior art formation testing devices is insufficient to reliably determine fluid types over such short intervals as ten feet. In fact, the estimated absolute accuracy of currently available formation testing devices is often considered by those active in well logging analysis to be even less than the plus or minus 0.5 psia which was assumed in the above examples.

It should be noted that the majority of examples published in the literature illustrating the use of formation testing devices involve earth formations which are many hundreds of feet in vertical depth. This fact notwithstanding, nearly all wells drilled in todays economic environment encounter formations of ten feet or even less in thickness which, if filled with moveable gas or oil, would justify well completion. This reality tends to highlight the inadequacies of the currently available formation testing devices.

A need exists for a formation testing device with the ability to harness the resolution capacity of commercially available quartz gauges to measure the difference in absolute formation fluid pressure between two well bore depths.

A need also exists for a formation testing device which provides a differential pressure reading indicative of the difference in formation fluid pressure at two well bore depths.

A need also exists for such a formation testing device in which the vertical distance between the two measuring points is fixed with great accuracy.

SUMMARY OF THE INVENTION

The formation testing apparatus of the invention is used for testing subsurface earth formations penetrated by a borehole. The testing apparatus includes a body of the type adapted to be suspended in a well bore penetrating such formations. A first sealing means is carried on the body and has a first central opening therein. The first sealing means is adapted for sealing engagement with the well bore to isolate a first portion thereof adjacent to said first central opening from well bore fluids. A second sealing means is carried at a different location longitudinally on said body and has a second central opening therein. The second sealing means is adapted for sealing engagement with the well bore to isolate a second portion thereof adjacent to said second central opening from well bore fluids.

Actuating means are provided for moving the first and second sealing means into sealing engagement with the well bore to establish communication at the first and second sealing means with connate fluids in the earth formations surrounding the borehole. A first sample-collecting means is carried by the body and is connected by a first sample passageway with the first central opening for receiving samples of connate fluids produced from such formations. A second sample collecting means is carried by the body and connected by a second sample passageway with the second central opening for receiving samples of connate fluids produced from such formations.

A primary control fluid passage containing a control fluid of known density is pressure communicative with the connate fluid contained in the first sample passageway. A secondary control fluid passage containing a control fluid of known density is pressure communicative with the connate fluid contained in the second sample passageway. Pressure sensing means are provided for sensing the pressure of the known density control fluid in the primary and secondary fluid passages and for comparing the pressures to determine a fluid pressure-depth gradient from which the nature of the connate fluid in the earth formations adjacent the formation testing device can be predicted.

The pressure sensing means can include an absolute pressure gauge and valve means for alternately communicating the pressure in the primary and secondary control fluid passages to the absolute pressure gauge. The pressure sensing means can also include a differential pressure gauge in fluid communication with the primary and secondary control fluid passages for simultaneously sensing the pressures and providing a differential pressure reading between said pressures.

Additional objects, features and advantages will be apparent in the written description which follows.

DETAILED DESCRIPTION OF THE INVENTION

Figures 1, 2:
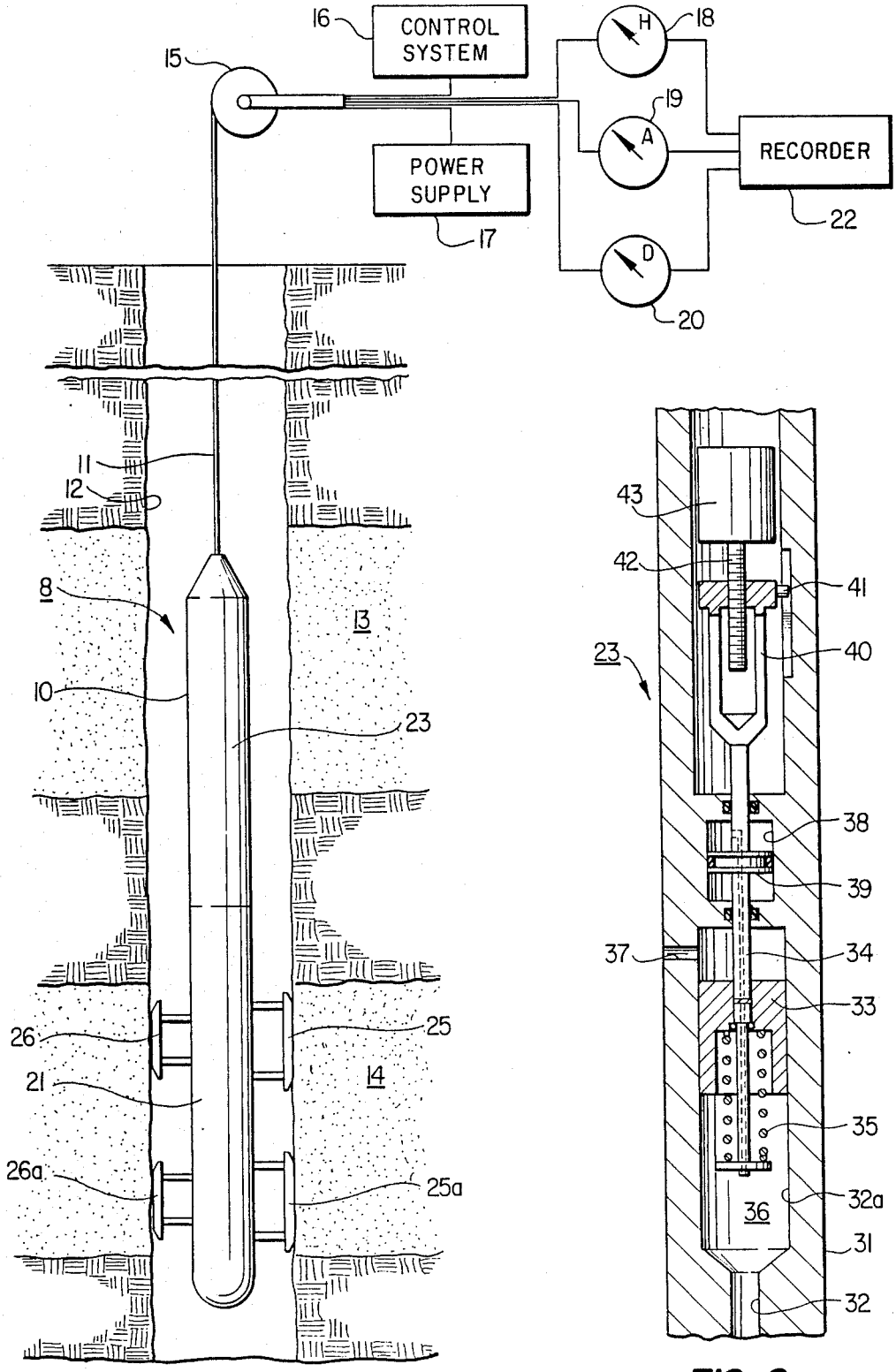
FIG. 1 is a simplified, schematic view of a formation testing device of the invention with the body of the device suspended by a wireline within a borehole.
FIG. 2 is an isolated view of the actuating portion of the formation testing device of FIG. 1.

FIG. 1 shows a formation testing apparatus incorporating the principles of the present invention designated generally as 8. The apparatus 8 is shown suspended by a multi-conductor cable 11 in a well bore 12 which traverses one or more earth formations 13, 14 where testing or sampling will be performed. The cable 11 is carried by a spool and winch 15 at the earth surface and is connected with typical surface equipment including a tool-control system 16, a power supply 17, suitable pressure indicating devices such as gauges 18, 19 and 20 and a recording device 22. Such surface equipment is known to those skilled in the art and is described, e.g., in U.S. Pat. No. 3,344,860, issued Oct. 3, 1967, to Voetter; U.S. Pat. No. 3,261,402, issued July 19, 1966, to Whitten, and others.

The formation testing apparatus 8 includes an elongated body 10 adapted to be passed through a well bore which is comprised of an actuating section 23 and tester section 21. As illustrated, the body 10 is transportable through a well bore and can be positioned adjacent to a selected formation zone 13 or zone 14 for sampling the pressure of the fluids in each of the formation zones.

OVERALL OPERATION

Before describing the component parts of the formation testing apparatus, a brief description of the overall operation will be provided. The body 10 is first lowered to a desired depth on the cable 11. As the body 10 is lowered in the well bore, it passes through a weighted well bore fluid commonly called "mud". The surface gauges 18 and 19 provide an indication of the hydrostatic pressure detected by the tool in the well bore while the tool is passed through the well bore.

The surface gauge 18 is connected to pressure transducer or sensor 18*a* (FIG. 3*a*) in the tester section 21 and is used to indicate pressure of hydraulic fluid in the tester. The surface gauge 19 is connected to pressure transducer or sensor 19*a* (FIG. 3*a*) to measure the pressure of the fluid in channel or passage 99. The surface gauge 20 is connected to differential pressure transducer or sensor 20*a* to measure the differential pressure of the fluid in passages 88 and 90. Pressure transducers of the type described are commercially available and will be familiar to those skilled in the art. The pressure transducers or sensors 18*a* and 19*a* can be, e.g. the previously described Hewlett Packard HP2813E/D quartz gauges. When the tool is located next to a formation 14 to be tested, a command from surface control system 16 causes internal components in the actuating section 23 and the testing section 21 to cause first annular sealing means 25 and second annular sealing means 25*a*, as well as diametrically opposed backup shoe means 26 and 26*a* to be moved outwardly into engagement with the wall of the well bore to the position illustrated in FIG. 5*a*. The general construction and function of annular sealing means 25, 25*a* and backup shoe means 26, 26*a* for this purpose are well known.

Figure 3A:
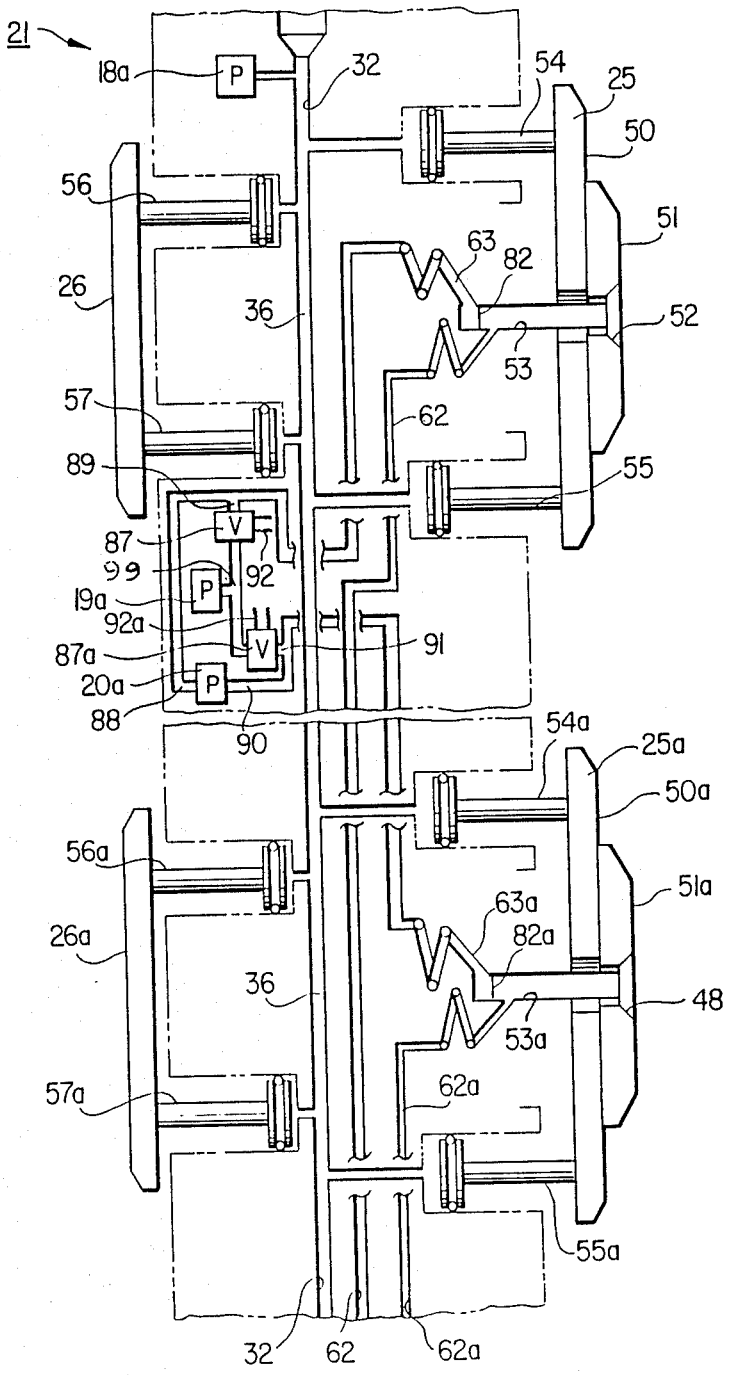
FIG. 3*a* is a schematic view of the device of the invention showing the first and second sealing means in the relaxed position.

The first annular sealing means and shoe means 25 and 26 are selectively extendable and retractable relative to the well tool. Second annular sealing means and shoe means 25*a* and 26*a* are likewise extendable and retractable relative to the well tool. As shown in FIG. 3*a*, the first and second annular sealing means 25, 25*a* are connected to the same hydraulic pressure channel 32 as are shoe means 26 and 26*a*. Thus, annular sealing means 25 and 25*a* are extended and retracted simultaneously with shoe means 26 and 26*a*. When the annular sealing means 25 and 25*a* sealingly engage the wall of the well bore, a temporary fluid sample may be taken into the tool through either or both annular sealing means 25 and 25*a*. A fluid pressure measurement may then be taken of the fluid located adjacent to the first and second segments of the well bore wall which are isolated from the borehole fluid by the annular sealing means 25 and 25*a*. Also, a differential pressure measurement may be taken of the fluid adjacent to the segments of the well bore wall. After the testing process is complete, the annular sealing means 25 and 25*a* and shoe means 26 and 26*a* may be retracted to the well tool.

THE ACTUATING SECTION

The actuating section 23 of the apparatus 8 will be familiar to those skilled in the art and is described, e.g., in U.S. Pat. No. 4,210,018. As shown in FIG. 2, the actuating section 23 includes a housing member 31 with a hydraulic cylinder 32*a* which opens to a hydraulic fluid passage 32. In the housing member 31 is a piston 33 which forms a sliding seal within the cylinder 32*a*. Piston 33 is mounted on a piston rod 34. A spring 35 on the piston rod 34 normally urges the piston 33 upwardly into engagement with a shoulder stop on the piston rod 34. The shoulder stop on the piston rod engages the piston 33 to move the piston 33 downwardly to transmit pressure to the hydraulic fluid 36 in the cylinder 32*a* and fluid passage 32. Above the piston 33 the housing 31 has a port 37 which opens to the mud fluid in the well bore 12. Thus mud pressure is transmitted to the piston 33 and to the hydraulic fluid 36 independently of the action of the piston rod 34 on the piston.

Above the cylinder 32*a* is an internal chamber 38 which receives an enlarged piston section 39 on the piston rod 34. Hydraulic fluid 36 from the cylinder 32*a* is admitted to the volume or space above the piston section 39 by means of an internal passage through the piston rod 34. The volume or space in chamber 38 below the piston section 39 is at atmospheric pressure. Above the chamber 38, the piston rod 34 has an upper adapter 40 which has a nut threadedly receiving a lead screw 42. The adapter 40 is connected by a pin 41 to a vertical guideway in the tool housing. Thus, as the lead screw 42 is turning, the adapter 40 is moved longitudinally of the tool and the piston rod 34 is moved in a vertical direction. The lead screw 42 is driven by an electric, reversible motor 43 which is controlled from the surface control system 16.

THE TESTER SECTION

Referring now to FIG. 3*a*, the tester section 21 of the tool is schematically illustrated. The tester section 21 includes first annular sealing means 25 which has a metal plate 50 with a curvature to conform to the curvature of the well bore. On the forward face of the metal plate 50 is a resilient sealing pad 51. The sealing pad has a central fluid admitting, opening 52. Opening 52 connects to a first flow passage 53 which is a tubular passage generally inward and transverse to the pad 51. The first flow passage 53 is intersected by a first sample passageway 62. Longitudinally spaced piston and piston rods 54 and 55 are coupled to the pad plate 50 and are responsive to fluid pressure in the passage 32 and in the well bore to extend or retract the pad plate 50 relative to the section 21. Similarly, the first back-up shoe 26 has a curvature about a vertical axis for engaging the wall of the borehole and longitudinally spaced piston rods 56 and 57. Pistons 56 and 57 are also responsive to fluid pressure in the passage 32 and in the well bore to extend or retract the shoe 26 relative to the tester section 21.

The second annular sealing means 25*a* is positioned on the tester section 21 at a known distance below the first annular sealing means 25 and has a similar design. The annular sealing means 25*a* includes a metal plate 50*a* with a curvature to conform to the curvature of the well bore. On the forward face of the metal plate 50*a* is a resilient sealing pad 51*a*. The sealing pad has a central fluid admitting, opening 48. Opening 48 connects to a second flow passage 53*a* which is generally inward and transverse to the pad 51*a*. Longitudinally spaced piston rods 54*a* and 55*a* are coupled to the metal plate 50*a* and are responsive to fluid pressure in the passage 32 and in the well bore to extend or retract the metal plate 50*a* relative to the tester section 21. Similarly, the first back-up shoe 26*a* has a curvature about a vertical axis for engaging the wall of the borehole and longitudinally spaced apart piston rods 56*a* and 57*a*. Pistons 56*a* and 57*a* are also responsive to fluid pressure in the passage 32 and in the well bore to extend or retract the shoe 26*a* relative to the tester section 21.

First sample passageway 62 runs longitudinally down the tool body 10 and terminates at the upper end of a bore or cylinder 67 (FIG. 3*b*) which opens into an expandable space 71 located above a piston segment 69. The cylinder 67, in turn, opens to a lower, enlarged bore or cylinder 68. The piston segment 69 and stepped segment 70 are slidably mounted in the cylinders 67 and 68 respectively. The expandable space 71 above the piston segment 69 is connected by virtue of first sample passageway 62, to the first flow passage 53 in the pad 51. The bottom part of the cylinder 68 below the piston segment 70 contains a spring 74 for normally urging the piston segment 70 to its uppermost position and maintaining the space 71 at its smallest volume. Cylinder 68 is also connected by a passage 75 to the mud or fluid pressure in the well bore.

The second flow passage 53*a* (FIG. 3*a*) beginning at pad 51*a* is coupled to a second sample passageway 62*a*. The second sample passageway 62*a* terminates at the upper end of a bore or cylinder 67*a* (FIG. 3*b*) and opens into an expandable space 71*a* located above the piston segment 69*a*. The cylinder 67*a*, in turn, opens to a lower, enlarged bore or cylinder 68*a*. Slidably and sealingly mounted in the cylinders 67*a* and 68*a* is a stepped piston with segment 69*a* in the cylinder 67*a* and a segment 70*a* in the cylinder 68*a*. The expandable space 71*a* above the piston segment 69*a* is connected by virtue of second sample passageway 62*a*, to the second flow passage 53*a* in the pad 51*a*. The bottom part of the cylinder 68*a* below the piston segment 70*a* contains a spring 74*a* for normally urging the piston segment 70*a* to its uppermost position and maintaining the space 71*a* at its smallest volume. Cylinder 68*a* is also connected by a passage 75*a* to the mud or fluid pressure in the well bore.

Figure 4:
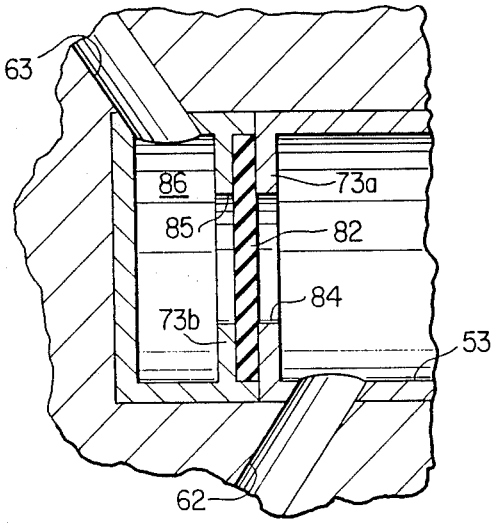
FIG. 4 is an isolated view of the primary fluid passage of the device of FIG. 1 which contains a control fluid of known density.

As shown in FIG. 4, a first fluid separation means, such as pressure transmitting diaphragm 82 is mounted within the first flow passage 53 radially inward of the point of intersection with the first sample passageway 62. The flexible diaphragm 82 has an outer gasket region which is sandwiched between flanges 73*a* and 73*b*. An opening 84 defined between flanges 73*a*, 73*b* in the first flow passage 53 exposes flexible diaphragm 82 to fluid in first flow passage 53. A similar opening 85 exposes flexible diaphragm 82 to control fluid 86 contained in a primary control fluid passage 63. As a result, the diaphragm 82 represents a pressure responsive area exposed to fluid in first flow passage 53. Flexible diaphragm 82 serves to conduct pressure from the fluid in first flow passage 53 to the control fluid in the primary control fluid passage 63. Preferably, the control fluid in passage 63 is a substantially incompressible liquid, such as oil.

A second fluid separation means, diaphragm 82*a* is mounted in the second flow passage 53*a*. The construction and operation of pressure transmitting diaphragm 82*a* is identical to that of pressure transmitting diaphragm 82. Pressure of fluid in second flow passage 53*a* is conducted through flexible diaphragm 82*a* to control fluid 86 in a secondary control fluid passage 63*a*. Control fluid 86 is also preferably a liquid of known density such as substantially incompressible oil.

Returning to FIG. 3*a*, passage 63 forks into two branches, one branch, passage 89 connects to valve 87, the other branch 88 connects to differential pressure transducer or sensor 20*a*. Passage 63*a* forks into two branches, one fork, passage 90 connects to differential pressure transducer or sensor 20*a* and the other passage 91 connects to valve means 87*a*. Sensor 20*a* provides measurements of the fluid pressure differences between passages 88 and 90. These measurements are indicated on surface gauge 20 and are recorded by surface device 22. Passages 88 and 90 are, of course, at no time fluid connected at sensor 20*a* or at any other location in the tool.

Valve means 87 and 87*a* can be controlled remotely, preferably, by operation of tool-control system 16, by means of electrical leads 92 and 92*a* extending from valve means 87 and 87*a* to the remote location. Valve means 87 and 87*a* are selectively operated to prevent fluid communication between passageways 63 and 63*a*. That is, when valve means 87 is open and 87*a* closed, passage 89 and passage 99 are connected. When valve means 87*a* is open and valve means 87 is closed, passage 91 is connected with passage 99. Passage 99 fluidly connects with pressure transducer or sensor 19*a*. Pressure transducer or sensor 19*a* can transmit to surface device 19 a pressure measurement to be recorded by surface recorder 22. Thus, depending upon the position of valve means 87 and 87*a*, a fluid pressure measurement in passage 89 or in passage 91 may be taken.

A suitable valve 87 is described in U.S. Pat. No. 4,416,152, issued Nov. 22, 1983, the disclosure of which is hereby incorporated by reference. The valve is also commercially available from Atkomatic Valve Company under part number 15-885 and is supplied off-the-shelf with a solenoid control system. A suitable electrical command and switching system for the valve is described in U.S. Pat. No. 3,780,575, which is incorporated herein by reference.

Figure 3B:
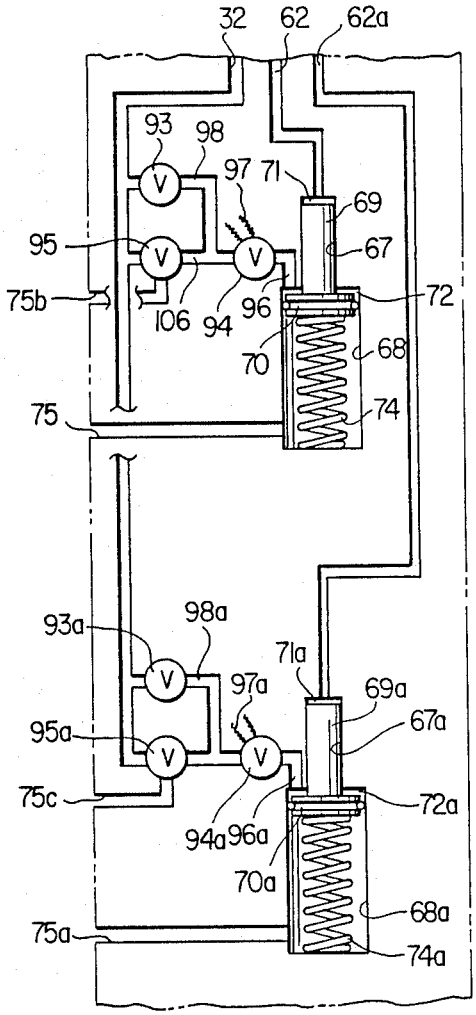
FIG. 3*b* is a downward continuation of FIG. 3*a* showing the sampling portion of the device.

Referring again to the sampling portion of the tool shown in FIGS. 3*b*, valve means 94 and 95 are located in line between passage 32 and passage 96. Valve means 95 permits fluid flow only if the pressure of fluid in passage 32 is a certain selected pressure magnitude higher than the pressure of the borehole fluid. Passage 75*b* opens at the outer surface of the tool 10 and connects the borehole fluid with valve means 95, thus facilitating the comparison of borehole fluid pressure with the pressure of fluid in passage 32. The arrangement of valve means 95 is such that borehole fluid has no access to the passage 32. Valve means 94 can be controlled remotely, preferably from control system 16, by means of electrical leads 97 extending from the valve 94 to the surface location. When valve means 94 is in open position and the pressure of fluid in passage 32 is at least a certain magnitude of pressure greater than the borehole fluid pressure, with that magnitude being determined by the arrangement of valve means 95, fluid in passage 32 can flow from passage 32 through valve means 95, valve means 94 and into passage 96. Passage 96 opens into the space 72 above piston segment 70. As a result of the hydraulic pressure of the entering fluid, piston segment 70 is driven downwardly, space 72 expands and spring 74 is compressed. In order to supply additional fluid to passage 32, the motor 43 is operated causing replacement fluid to be pumped into line 32. The downward movement of piston segment 69 causes a small fluid sample from the formation to be received into the expanding space 71.

Figure 6:
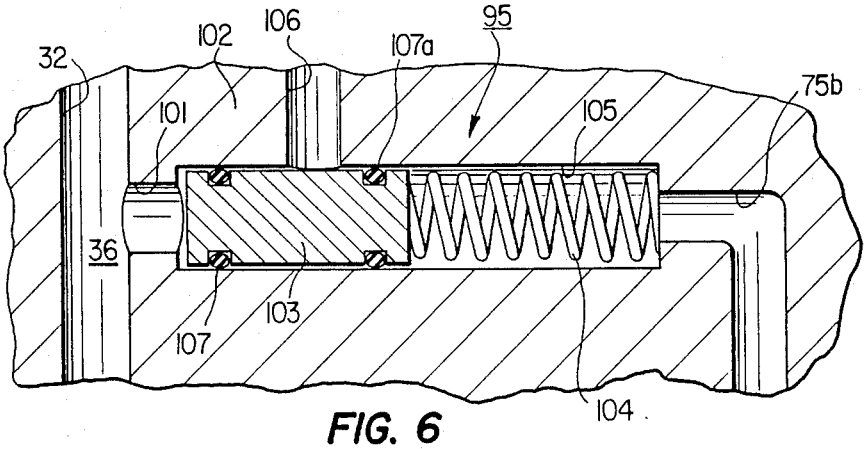
FIG. 6 is an isolated view of the valve means used in the sampling portion of the device.

Referring to FIG. 6, valve means 95 is shown in detail. Passage 101 within the valve body 102 communicates with passage 32. A cylindrical piston 103 is free to move in valve body 102. A spring 104 applies continuous pressure to piston 103, causing it to be in the position shown when the pressure of the fluid in passageway 32 is equal to the pressure of the well bore fluid which freely enters the space 105 in cylindrical housing 102 containing spring 104 via passage 75*b*. When the pressure of the fluid in passageway 32 is higher than the pressure of the well bore fluid in space 105, piston 103 exerts a force on spring 104 causing it to compress. When this force is strong enough to cause sufficient compression, piston 103 moves to the right a distance sufficient to permit fluid contact between passageway 32 and passageway 106. Passageway 106 leads to valve means 94. O-rings 107 and 107*a* provide a sliding seal to prevent fluid leakage between the valve body 102 and piston 103. The construction of valve 95*a* is identical to that of valve 95.

The arrangement of valve means 95*a* is such that borehole fluid has no access to the passage 32. Valve means 94 is preferably closed before valve means 94*a* is opened. Valve means 94*a* can be controlled remotely, preferably from control system 16, by means of electrical leads 97*a* extending from the valve 94*a* to the remote location. When valve means 94*a* is in open position and the pressure of fluid in passageway 32 is at least a certain magnitude of pressure greater than the borehole fluid pressure, with that magnitude being determined by the arrangement of valve means 95*a*, fluid in passageway 32 can flow from passageway 32 through valve means 95*a*, valve means 94*a* and into passage 96*a*. Passage 96*a* opens into the space 72*a* above piston segment 70*a*. As a result of the hydraulic pressure of the entering fluid, piston segment 70*a* is driven downward, space 72*a* expands and spring 74*a* is compressed. In order to supply additional fluid to passage 32, the motor 43 is operated causing the actuating system to pump replacement fluid into passageway 32. The downward movement of piston segment 70*a* causes a small fluid sample from the formation to be received into the expanding space 72*a*.

SINGLE PRESSURE TEST OPERATION

In the running-in position shown in FIG. 3*a*, the pressure transducer or sensor 18*a*, which is connected to passage 32, will detect the hydrostatic/mud pressure. The pressure transducer or sensor 19*a* will also detect mud pressure prior to the sealing pads 51 and 51*a* and backup shoes 26 and 26*a* being set against a well bore.

Figure 5A:
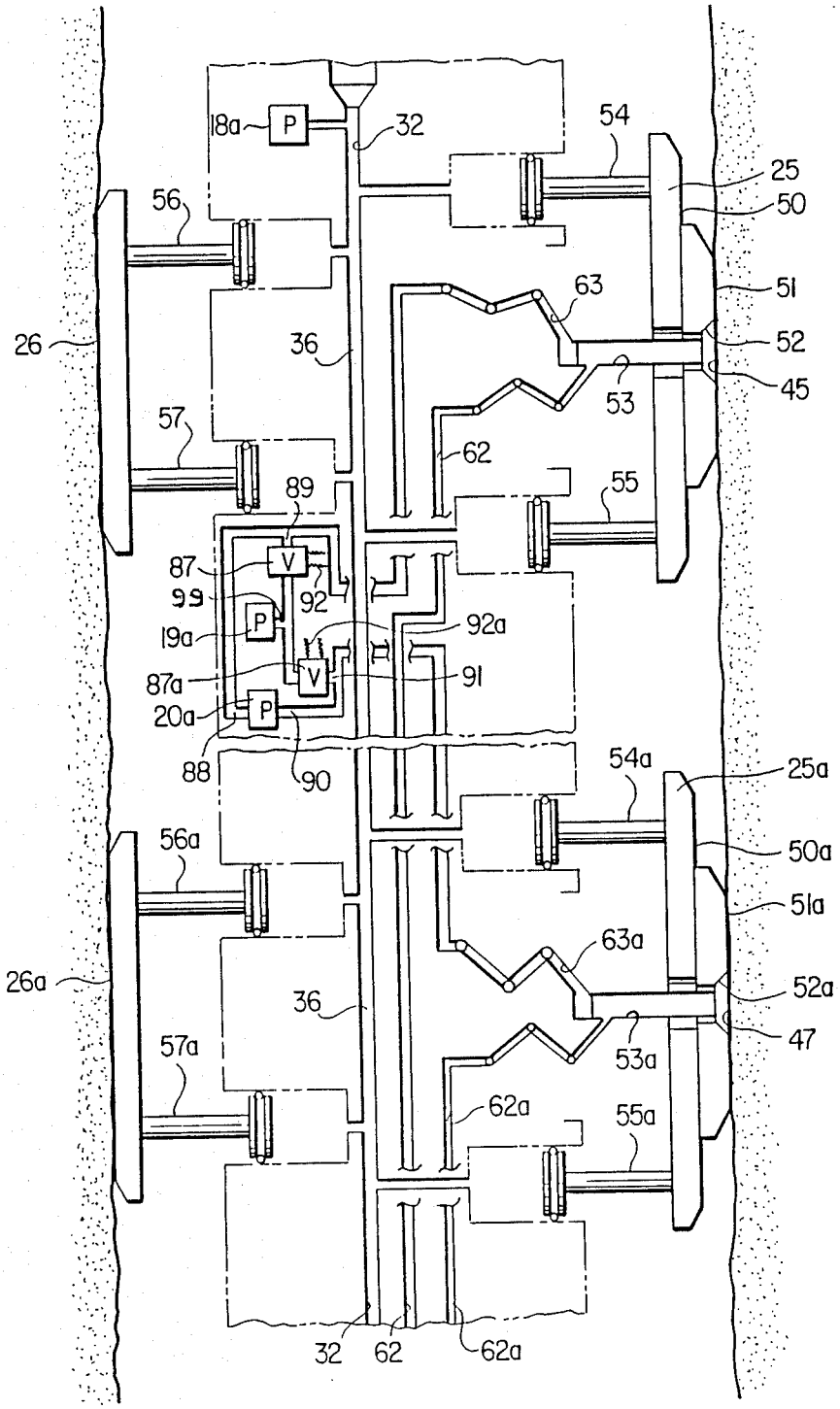
FIG. 5*a* is a schematic view of the device of the invention showing the first and second sealing means in the extended position.

To sample the pressure of the fluids in a formation at a given level, the tool is positioned at the desired location and motor 43 (FIG. 2) operated to increase the pressure in the hydraulic fluid 36 in the passage 32. As the pressure in passage 32 is increased, the shoes 26 and 26*a* and the sealing pads 51 and 51*a* are moved against the wall of the well bore by virtue of the pressure in the passage 32 acting on the pistons. FIG. 5*a* illustrates the position of sealing pads 51 and 51*a* and shoes 26 and 26*a* following this process. Seals are thus established between pads 51 and 51*a* and the well bore surface which isolate two small portions of the well bore surface from the well bore fluid. As is illustrated, one isolated portion 45 is adjacent passage 53 and the other isolated portion 47 is adjacent passage 53*a*. The preferred embodiment of the formation testing apparatus 8, permits the independent measurement of fluid pressure at sealing pad 51 and sealing pad 51*a* and the measurement of the differential pressure of the fluids at sealing pads 51 and 51*a*.

During the process of taking temporary fluid samples from the formation adjacent to openings 52 and 52*a* (FIG. 5*a*), the pressure of fluid in fluid passages 53 and 53*a* can be detected by pressure transducer or sensor 19*a*. If valve means 87 is open and valve means 87*a* is closed, fluid communication between passage 89 and passage 99 is established and the fluid pressure in first flow passage 53 is detected. If valve means 87 is closed and valve means 87*a* is open, fluid communication between passage 91 and passage 99 is established and the pressure in second flow passage 53*a* can be detected. If a period of time is allowed to elapse, sufficient formation fluid will enter first and second flow passages 53 and 53*a* and fluid pressure in those passageways will become equal to the pressure of fluid in the formation adjacent to each annular sealing pad.

The preferred embodiment of the apparatus 8 provides that valve means 87 and 87*a* can be opened and closed an unlimited number of times during the pressure measuring process, thus permitting the opportunity to rapidly change the pressure exposure of transducer 19*a* from fluid pressure in passage 89 to passage 91 or, the reverse, from passage 91 to passage 89. During the short time interval required to take a fluid pressure measurement and then switch valve means 87 and 87*a* to the opposite position and take a second pressure measurement, the rate at which the temperature of pressure transducer or sensor 19*a* is changing can be expected to remain nearly constant.

Differential pressure transducer or sensor 20*a* detects the pressure difference between fluid in passages 88 and 90. In the preferred embodiment, the pressure measuring range of device 20*a* is limited to a comparison of pressure in passage 88 with pressure in passage 90 of plus or minus 25 psi, and thus device 20*a* can be expected to normally only provide useful information when both sealing pads 51 and 51*a* have formed successful seals against the borehole wall.

Figure 5B:
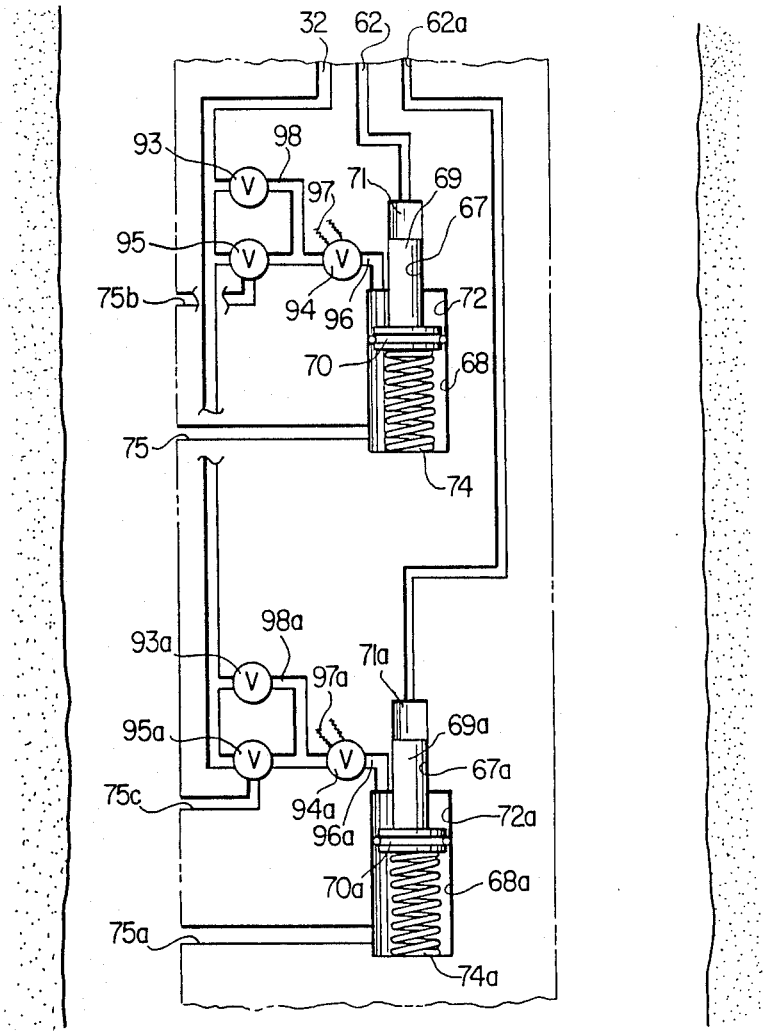
FIG. 5*b* is a downward continuation of FIG. 5*a* showing the sampling portion of the device.

When the formation fluid pressure measuring process is over at that location in the well bore, valve means 94 (FIG. 5*b*) is again opened and the motor 43 is reversed thereby releasing the hydraulic pressure of fluid in passage 32. The springs 74 and 74*a* and well bore fluid pressure applied against the bottoms of piston segments 70 and 70*a* provide force to eject the temporary fluid samples from the spaces 71 and 71*a* above the piston segments 69 and 69*a*. Hydraulic fluid simultaneously returns to passage 32 from spaces 72 and 72*a* above piston segments 70 and 70*a* via bypass passages 98 and 98*a*. Passages 98 and 98*a* contain one-way valves 93 and 93*a*. When the piston segments 69 and 69*a* are returned to their initial condition and valve means 94 and 94*a* are closed, the expandable spaces 71 and 71*a* are thus prepared to receive another set of temporary samples for purposes of testing pressure. Thus, the tool 10 can be moved to any number of locations where the fluid pressure of a formation may be sampled in a similar manner.

OPERATION FOR MULTIPLE PRESSURE TESTS

The operation of the tool for multiple pressure tests involves positioning the tool at the location where the pressure test is desired. The motor 43 is actuated to move the piston 33 and pressure up the hydraulic fluid in the hydraulic pressure passage 32. The pressure in passage 32 is sensed by the pressure sensor 18*a* and indicated on gauge 18 while the fluid pressure in either the first flow passage 53 or second flow passage 53*a* is coupled to pressure sensor 19*a* depending upon the position of valves 87 and 87*a* so that mud pressure is indicated on the pressure gauge 19*a*. As the pressure in passage 32 is increased, the shoe and sealing pad means are urged against the borehole wall to bring the sealing pads 51 and 51*a* into sealing engagement with the wall of the well bore. The sealing of the pads against the wall of the well bore is indicated by an increase in hydraulic pressure on gauge 18. Valve means 87 and 87*a* are then operated using control system 16 to permit pressure transducer or sensor 19*a* to detect fluid pressure in first flow passage 53. Valve means 94 is opened and motor 43 is again actuated to move the piston 33 and to supply additional hydraulic fluid to passage 32. Piston segment 69 is thereby lowered and a fluid sample expelled from the formation at opening 52, adjacent to first flow passage 53, is ingested into space 71. Sensor 19*a* provides a pressure measurement of the fluid pressure of first flow passage 53 as the pressure builds up to formation fluid pressure after having been reduced below that level by the expansion of space 71.

A similar sequence of events can then be carried out using sealing pad 51*a*. Valve means 87 and 87*a* are operated so as to permit sensor 19*a* to detect pressure in second flow passage 53*a*. Valve means 94 is temporarily closed, valve means 94*a* is opened and motor 43 is again actuated to move the piston 33 and to supply additional hydraulic fluid to fluid pressure passage 32. Piston segment 69*a* is thereby lowered and a fluid sample expelled from the formation at opening 52*a*, adjacent to second flow passage 53*a*, is ingested into space 71*a*. Sensor 19*a* detects the pressure of second flow passage 53*a* as the pressure builds up to formation fluid pressure level after having been reduced below that level by the expansion of space 71*a*.

The difference between the fluid pressures in first flow passage 53 and second flow passage 53*a* can be determined by remotely operating valve means 87 and 87*a*, preferably, using control system 16, so that sensor 19*a* is pressure connected with first flow passage 53, then taking a first pressure reading of the fluid in passage 99 using sensor 19*a*. Next, remotely operating valve means 87 and 87*a* so that sensor 19*a* is pressure connected to second flow passage 53*a* and then taking a second pressure reading of the fluid in passage 99. The nature of the sampled fluid can be determined by subtracting the first pressure reading from the second and adding the product of the vertical pressure gradient of the known density fluid 86 and the distance longitudinally between the pads 51 and 51*a*.

For example, assume (1) the pressure reading by sensor 19*a* as indicated on surface gauge 19, when pressure connected to first flow passage 53, is 2,000.74 psi; (2) the pressure reading by sensor 19*a* as indicated on surface gauge 19, when pressure connected to second flow passage 53*a*, is 2,001.17 psi; (3) the longitudinal distance between sealing pads 51 and 51*a* is 5 feet; and (4) the density of the measuring fluid 86 is 52.97 pounds (mass) per cubic foot; the following calculations can then be made:

$$\text{Press. grad. (fluid 86)} = 52.97/144 = 0.368 \text{ psi/ft}$$
$$\text{Fluid pressure diff.} = (2{,}001.17 - 2{,}000.74) + (0.368)(5)$$
$$= 2.27 \text{ psi per 5 feet}$$

Using the above result, the indicated pressure gradient per foot is 0.454 psi. Recalling the previous discussion, it can be concluded that a quartz pressure probe with 0.01 psi resolution would conservatively permit a pressure gradient error of no more than plus or minus 0.004 psi. Thus, the pressure range which can be safely assumed to include the true pressure gradient of the formation fluid is 0.46–0.45 psi per foot. Clearly, salt water is indicated to be the moveable formation fluid.

A second method of determining the pressure gradient of the formation fluid is to obtain a differential fluid pressure reading using differential pressure transducer or sensor 20*a*. Sensor 20*a* measures the pressure difference between passage 88 and 90 as shown in FIG. 3*a*. This pressure reading is added to the product of the pressure gradient of the control fluid 86 and the distance between the formation fluid at sealing pads 51 and 51*a*. When this result is divided by the distance between the sealing pads 51 and 51*a*, the indicated formation fluid pressure gradient is obtained.

For example, if (1) the differential pressure reading of sensor 20*a*, as indicated on surface gauge 20, shows the pressure in passage 88 to be 0.02 psi higher than in passage 90; (2) the pressure gradient of the control fluid 86 is 0.368 psi per foot; and (3) the distance between sealing pads 51 and 51*a* is 5 feet, then the indicated fluid pressure gradient is calculated as follows:

$$\text{Formation Fluid Press. Grad.} = (-0.02 + (0.368)(5))/5 = 0.36 \text{ psi/ft}$$

The range of pressure which would, with certainty, include the true fluid pressure gradient of the formation would depend upon the accuracy of sensor 20*a*.

When the pressure test is concluded, valve means 94, 94*a* are again opened, and motor 43 is reversed to relieve the pressure in the passage 32 so that the pads and shoes are unseated from the wall of the well bore and the piston segments 69 and 69*a* are returned to their initial condition by virtue of mud pressure acting through the ports 75 and 75*a* and the additional force of the springs 74 and 74*a* acting on piston segments 70 and 70*a*. The hydraulic fluid in the spaces 72 and 72*a* is returned to passage 32 via bypass passages 98 and 98*a*, both of which include a one-way valve (93,93*a*). Valves 94 and 94*a* can then be closed and the tool can be moved to a second location and the above described procedure for testing a formation repeated.

An invention has been provided with several advantages. Because an absolute pressure reading can be taken at two depths simultaneously, the difference in the readings provides a highly reliable indication of the nature of the fluid or fluids sampled. Depth errors are eliminated because the pressure measuring points are located a known distance apart. Because the changes in pressure of the fluid sampled are related to a fluid of known density, a highly accurate calculation of the pressure-depth gradient can be made.

While the invention has been shown in only one of its forms, it is not thus limited but is susceptible to various changes and modifications without departing from the spirit thereof.

I claim:

1. A formation testing apparatus for testing subsurface earth formations penetrated by a borehole, comprising:

a body of the type adapted to be suspended in a well bore penetrating such formations;

first sealing means carried on said body and having a first central opening therein, said first sealing means being adapted for sealing engagement with said well bore to isolate a first portion thereof adjacent to said first central opening from well bore fluids;

a second sealing means carried at a different location longitudinally on said body and having a second central opening therein, said second sealing means being adapted for sealing engagement with said well bore to isolate a second portion thereof adjacent to said second central opening from well bore fluids;

actuating means for moving said first and second sealing means into sealing engagement with said well bore to establish communication at said first and second sealing means with connate fluids in earth formations there beyond;

a first sample-collecting means carried by said body and connected by a first sample passageway with said first central opening for receiving samples of connate fluids produced from such formations;

a second sample-collecting means carried by said body and connected by a second sample passageway with said second central opening for receiving samples of connate fluids produced from such formations;

a primary control fluid passage containing a control fluid of known density which is pressure communicative with the connate fluid contained in said first sample passageway;

a secondary control fluid passage containing a control fluid of known density which is pressure communicative with the connate fluid contained in said second sample passageway; and pressure sensing means for sensing the pressure of said known density control fluid in said primary and secondary control fluid passages and for comparing said pressures to determine a fluid pressure-depth gradient from which the nature of the connate fluid in the earth formations adjacent said formation testing device can be predicted.

2. The formation testing apparatus of claim 1, wherein said pressure sensing means includes an absolute pressure gauge and valve means for alternately communicating the pressure in said primary and secondary control fluid passages to said absolute pressure gauge.

3. The formation testing apparatus of claim 1, wherein said pressure sensing means includes a differential pressure gauge in fluid communication with said primary and secondary control fluid passages for simultaneously sensing said pressures and providing a differential pressure reading between said pressures.

4. The formation testing apparatus of claim 1, wherein the control fluid of known density in said primary control fluid passage is a liquid of known density and the control fluid of known density in said secondary control fluid passage is a liquid of known density.

5. A wireline formation testing apparatus for testing subsurface earth formations penetrated by a borehole, comprising:

a body of the type adapted to be suspended on a wireline in a well bore penetrating such formations;

first sealing means carried on said body and having a first central opening therein which communicates with a first flow passage, said first sealing means being adapted for sealing engagement with said well bore to isolate a first portion thereof adjacent to said first central opening from well bore fluids;

a second sealing means carried at a different location longitudinally on said body and having a second central opening therein which communicates with a second flow passage, said second sealing means being adapted for sealing engagement with said well bore to isolate a second portion thereof adjacent to said second central opening from well bore fluids;

actuating means for moving said first and second sealing means into sealing engagement with said well bore to establish communication at said first and second sealing means with connate fluids in earth formations there beyond;

a first sample-collecting means carried by said body and connected by a first sample passageway with said first flow passage and said first central opening for receiving samples of connate fluids produced from such formations;

a second sample collecting means carried by said body and connected by a second sample passageway with said second flow passage and said second central opening for receiving samples of connate fluids produced from such formations;

a primary control fluid passage containing a control fluid of known density which is separated by a pressure transmitting diaphragm from said connate fluid contained in said first flow passage;

a secondary control fluid passage containing a control fluid of known density which is separated by a pressure transmitting diaphragm from the connate fluid contained in said second flow passage; and pressure sensing means for sensing the pressure of said known density control fluid in said primary and secondary control fluid passages and for comparing said pressures to determine a fluid pressure-depth gradient from which the nature of the connate fluid in the earth formations adjacent said formation testing device can be predicted.

6. The formation testing apparatus of claim 5, wherein said pressure sensing means includes an absolute pressure gauge and valve means for alternately communicating the pressure in said primary and secondary control fluid passages to said absolute pressure gauge.

7. The formation testing apparatus of claim 5, wherein said pressure sensing means includes a differential pressure gauge in fluid communication with said primary and secondary control fluid passages for simultaneously sensing said pressures and providing a differential pressure reading between said pressures.

8. The formation testing apparatus of claim 5, wherein said first and second flow passages extend from said first and second openings generally transverse to the longitudinal axis of said body where they are intersected by said first and second sample passageways and primary and secondary control fluid passageways, respectively.

9. The formation testing apparatus of claim 5, wherein the control fluid of known density in said primary control fluid passage is a liquid of known density and the control fluid of known density in said secondary control fluid passage is a liquid of known density.

10. The formation testing apparatus of claim 9, wherein said liquid of known density in said primary control fluid passage is a substantially incompressible oil and said liquid of known density in said secondary control fluid passage is a substantially incompressible oil.

11. A wireline formation testing apparatus for testing subsurface earth formations penetrated by a borehole, comprising:

a body of the type adapted to be suspended on a wireline in a well bore penetrating such formations;

first sealing means carried on said body and having a first central opening therein which communicates with a first flow passage, said first sealing means being adapted for sealing engagement with said well bore to isolate a first portion thereof adjacent to said first central opening from well bore fluids;

a second sealing means carried at a different location longitudinally on said body and having a second central opening therein which communicates with a second flow passage, said second sealing means being adapted for sealing engagement with said well bore to isolate a second portion thereof adjacent to said second central opening from well bore fluids;

actuating means for moving said first and second sealing means into sealing engagement with said well bore to establish communication at said first and second sealing means with connate fluids in earth formations there beyond;

a first sample-collecting means carried by said body and connected by a first sample passageway with said first flow passage and said first central opening for receiving samples of connate fluids produced from such formations;

a second sample collecting means carried by said body and connected by a second sample passageway with said second flow passage and said second central opening for receiving samples of connate fluids produced from such formations;

a primary control fluid passage containing a control fluid of known density which is separated by a pressure transmitting diaphragm from said connate fluid contained in said first flow passage;

a secondary control fluid passage containing a control fluid of known density which is separated by a pressure transmitting diaphragm from the connate fluid contained in said second flow passage;

a pressure transducer for sensing the pressure of said known density control fluid in said primary and secondary control fluid passages;

an electrically operated valve for alternately communicating the pressure in said primary control fluid passage and in said secondary control fluid passage to said pressure transducer, whereby said pressures can be compared to determine a fluid pressure-depth gradient from which the nature of the connate fluid in the earth formations adjacent said formation testing device can be predicted.

12. A method for testing earthern formations penetrated by a borehole to determine the nature of connate fluids contained in said formations, said method comprising the steps of:

suspending a body within said well bore, the body being provided with a first sealing means having a first central opening therein, and a second sealing means located a fixed longitudinal distance below said first sealing means and having a second central opening therein, said first and second sealing means being adapted for sealing engagement with said well bore to isolate a first and second portion thereof from well bore fluids;

moving the first and second sealing means into sealing engagement with the well bore to establish communication at said first and second sealing means with connate fluids in the surrounding earth formations;

communicating formation fluid pressure of the connate fluid entering said first central opening to a primary control fluid passage containing a control fluid of known density, the primary control fluid passage being pressure communicative with said first central opening by first fluid separation means provided at the entrance to said primary control fluid passage;

communicating formation fluid pressure of the connate fluid entering said second central opening to a secondary control fluid passage containing a control fluid of known density, the secondary control fluid passage being pressure communicative with said second central opening by second fluid separation means provided at the entrance to said secondary control fluid passage;

sensing the pressure of said known density fluid in said primary and secondary control fluid passages and comparing said pressures to determine a fluid pressure-depth gradient from which the nature of the connate fluid in the earth formations adjacent said formation testing device can be predicted.

13. The method of claim 12, further comprising the steps of:

providing said body with an absolute pressure gauge for sensing the pressure in said primary and secondary control fluid passages and providing valve means for alternately communicating the pressure in said primary and secondary control fluid passages to said absolute pressure gauge, whereby the difference in pressure between said primary and secondary control fluid passages can be calculated.

14. The method of claim 12, further comprising the steps of:

providing said body with a differential pressure gauge in fluid communication with said primary and secondary control fluid passages and simultaneously sensing said pressures whereby a differential pressure reading may be obtained between said primary and secondary control fluid passages.

15. The method of claim 12, wherein said first and second fluid separation means are pressure responsive diaphragms.

16. A method for testing earthern formations penetrated by a borehole to determine the nature of connate fluids contained in said formations, said method comprising the steps of:

suspending a body within said well bore, the body being provided with a first sealing means having a first central opening therein, and a second sealing means located a fixed longitudinal distance below said first sealing means and having a second central opening therein, said first and second sealing means being adapted for sealing engagement with said well bore to isolate a first and second portion thereof from well bore fluids;

moving the first and second sealing means into sealing engagement with the well bore to establish communication at said first and second sealing means with connate fluids in the surrounding earth formations;

communicating formation fluid pressure of the connate fluid of the earthern formation adjacent to said first central opening to fluid in said first central opening and communicating fluid pressure of fluid in said first central opening to a primary control fluid passage containing a control fluid of known density, the primary control fluid passage being pressure communicative with said first central opening by first fluid separation means provided at the entrance to said primary control fluid passage;

communicating formation fluid pressure of the connate fluid of the earthern formation adjacent to said second central opening to fluid in said second central opening and communicating fluid pressure of fluid in said second central opening to a secondary control fluid passage containing a control fluid of known density, the secondary control fluid passage being pressure communicative with said second central opening by second fluid separation means provided at the entrance to said secondary control fluid passage;

sensing the pressure of said known density fluid in said primary and secondary control fluid passages and comparing said pressures to determine a fluid pressure-depth gradient from which the nature of the connate fluid in the earth formations adjacent said formation testing device can be predicted.

* * * * *